US005709751A

United States Patent [19]

van der Meulen

[11] Patent Number: 5,709,751

[45] Date of Patent: Jan. 20, 1998

[54] SQUEEGEE APPARATUS FOR COATING SUBSTANTIALLY CYLINDRICAL OBJECTS

[75] Inventor: Antonius Maria van der Meulen, Helmond, Netherlands

[73] Assignee: Stork Screens, B.V., Boxmeer, Netherlands

[21] Appl. No.: 710,461

[22] Filed: Sep. 18, 1996

Related U.S. Application Data

[63] Continuation of Ser. No. 326,708, Oct. 20, 1994, Pat. No. 5,647,907.

[30] Foreign Application Priority Data

Oct. 20, 1993 [NL] Netherlands ..... 9301820

[51] Int. Cl.[6] ..... B05C 21/00

[52] U.S. Cl. ..... 118/413; 118/410; 101/120; 101/123; 101/167

[58] Field of Search ..... 118/100, 104, 118/203, 261, 410, 413; 101/120, 119, 123, 116, 167, 335; 15/245, 256.5, 256.52; 427/359

[56] References Cited

U.S. PATENT DOCUMENTS

| | | | |
|---|---|---|---|
| 2,884,654 | 5/1959 | Fall | 15/256.5 |
| 3,883,291 | 5/1975 | Clontier et al. | 118/203 |
| 3,890,896 | 6/1975 | Zimmer | 101/120 |
| 4,456,637 | 6/1984 | Takeda et al. | 118/118 |
| 5,099,783 | 3/1992 | Bourgeois | 101/120 |
| 5,151,132 | 9/1992 | Zimmer | 101/120 |
| 5,257,432 | 11/1993 | Duke | 15/256.5 |
| 5,376,177 | 12/1994 | Elvidge et al. | 118/410 |

FOREIGN PATENT DOCUMENTS

| | | | |
|---|---|---|---|
| 0307527 | 3/1989 | European Pat. Off. | 118/203 |
| 2212920 | 9/1973 | Germany . | |
| 311291 | 11/1973 | Germany . | |
| 469563 | 4/1969 | Switzerland . | |

*Primary Examiner*—Laura Edwards
*Attorney, Agent, or Firm*—Deveau, Colton & Marquis

[57] ABSTRACT

Squeegee assembly in particular intended for coating substantially cylindrical objects with a liquid or pasty material, at least comprising an annular squeegee with an outer mounting edge and an inner levelling edge, the latter comprising a ring member and/or ridges substantially extending in the intended direction of movement of the squeegee, the ridges defining grooves, which grooves are designed to form channels with the surface of the object to be coated.

17 Claims, 4 Drawing Sheets

SQUEEGEE APPARATUS FOR COATING SUBSTANTIALLY CYLINDRICAL OBJECTS

This is a continuation of application Ser. No. 08/326,708 filed on Oct. 20, 1994, now U.S. Pat. No. 5,647,907.

BACKGROUND OF THE INVENTION

The present invention in the first place relates to a squeegee assembly in particular intended for coating substantially cylindrical objects with a liquid or pasty material, at least comprising an annular squeegee with an outer mounting edge and an inner levelling edge.

Such a squeegee assembly is known from the prior art and is frequently used in coating devices and also manually in specially designed manual coating devices, in order to provide substantially cylindrical objects with a coating of material. Such a squeegee assembly is for example used for coating a seamless metal rotary screen printing cylinder, which is, for example, a nickel cylinder having a wall thickness of between 50–500 microns and comprising 20–200 holes per running cm, with a lacquer. After such a screen printing cylinder has been coated, that is to say the lacquer coating on the dams between the holes has a specific layer thickness and a suitable depth of penetration into the holes, said lacquer coating is partially removed in accordance with a pattern, while the remaining areas are hardened. Such a screen printing cylinder is then ready for screen printing, in which case a dye is pressed on a substrate to be printed through the open holes by means of an internal straight squeegee, as known from the prior art.

For the purpose of clarity in the following description reference will be made exclusively to the coating of a rotary screen printing cylinder with a lacquer. The device may, however, also be used for a large number of other applications, such as for example, painting or otherwise coating substantially cylindrical objects, like tubes or even substantially solid objects.

The coating of cylindrical objects with the aid of known squeegee assemblies has a number of important disadvantages. The accuracy with which such squeegee assembly has to be displaced along the object to be coated is required to be very high, as substantial differences in layer thickness and penetration depth of the material to be applied occur in the case of even the smallest eccentricity between the squeegee and the object. Furthermore the choice of the shape of the squeegee and its rigidity as well as the choice of the lacquer are relatively complicated and dependent on many factors. The layer thickness and penetration depth of the material to be applied to a screen printing cylinder are dependent on the rigidity of the squeegee, the speed of displacement of the squeegee and the properties of the lacquer, such as viscosity, solids content, surface tension etc. Up until now it has not been possible to apply relatively smooth thick coatings of lacquer in one coating run on the object and/or sufficient penetration depth into the holes of a screen; mainly avoiding the setting effect above the holes.

Further, different squeegees are required for upward and downward coating. During upward coating a relatively stiff squeegee is preferred, whereas with downward coating a more flexible squeegee is required. In case of a relatively stiff squeegee the squeegee assembly displacement means have to be designed in such a manner, that a very accurate displacement of the squeegee with respect to the cylinder to be coated it guaranteed. Moreover, the positioning of the screen printing cylinder in the coating device also has to be carried out very accurately. Even with very small deviations in the centering of the displacement of the squeegee over the cylinder, differences in layer thickness, streaks and even leakage phenomena are immediately observable.

During coating in the downward direction the more flexible squeegee can absorb greater variation in the centering of the squeegee and the cylinder, but in this case there is a greater dependency on the choice of the lacquer. The fact is that this coating method is largely dependent on the lacquer properties, together with the downward speed of movement of the squeegee. Finally this coating method is relatively slow (varying from 5–15 cm/min).

The squeegee assembly may comprise only an optionally clamped squeegee, but generally will also comprise a mounting block or e.g. a bowl part, which is used to mount the assembly in a coating device. Together with the squeegee and the cylinder surface to be coated during the coating operation, said mounting block or bowl part forms a reservoir which can generally contain substantially more than the amount of lacquer required.

SUMMARY OF THE INVENTION

The object of the present invention is to provide a squeegee assembly which does not have the above-mentioned disadvantages of the prior art and which can be used for coating substantially cylindrical objects without being limited to the very accurate displacement means. The squeegee assembly according to the invention to that end is characterized in that the levelling edge comprises ridges substantially extending in the intended direction of movement of the squeegee, said ridges defining grooves, which are designed to form channels with the surface of the object to be coated.

The squeegee assembly according to the invention is suitable for manually coating cylindrical objects, as well as for use in the known coating devices.

By the presence of the ridges on the levelling edge of the squeegee a relatively large amount of liquid or pasty material can be coated onto a substantially cylindrical object in one coating run, i.e. in the upward direction. The channels are formed by the grooves and the surface of the object to be coated, said grooves being defined by the ridges. The material to be applied can be pressed, or even flow through these channels and a very even distribution of material is obtained, whereas the centering of the squeegee assembly is also guaranteed, as the contact between the squeegee and the object to be coated is held constant by the presence of the ridges.

With prior art squeegee assemblies usually a maximum reproducible lacquer layer thickness of no more than about 5 microns can be coated onto a rotary screen printing cylinder in a single coating run. With the squeegee assembly according to the invention a layer thickness of about 30 microns is possible in a single coating run.

The ridges and grooves can be formed in the levelling edge of currently commercially available squeegees, by cutting, melting, machining etc.

Preferably, however, the ridges comprise spacer elements. Such spacer elements are advantageously wire elements, partially embedded in the levelling edge of the squeegee. Such wire elements can be designed in many different forms, most advantageously these wire elements are designed as ring elements. A ring element is a closed ring or a part thereof.

Such wire elements can be adhered to the levelling edge of the squeegee by means of welding, an adhesive, vulcanisation, etc.

Most preferably, the ring elements are designed as the turns of a helically embedded wire, which can be applied to the levelling edge by stitching through.

The spacer elements are advantageously embedded in the levelling edge between 5 and 95% of the maximum diameter thereof.

The spacer elements can be made from different materials, however preferably the material is a relatively wear resistant material, in particular steel wire or the like. Metal wire e.g. coated with a metal nitride, carbide, silicide or a chromide is also feasible.

The dimensions of the grooves will usually depend on the properties of the material to be coated, as well as on the layer thickness to be coated and are not critical. Preferably the grooves have a maximum depth of between 0.075 and 0.35 mm, more preferably between 0.1 and 0.3 mm, and a preferred maximum transverse dimension of below 10 mm, and more preferably between 2 and 5 mm.

The dimensions of the ridges are not particularly limited but preferably the part thereof which can contact the surface of the object to be coated is smaller than the maximum transverse dimension of the grooves. Advantageously said part is small enough with respect to the dimensions of the grooves that the streaks formed by the ridges can close by flowing before the material dries or otherwise hardens, thus assuring an undisturbed flat and smooth coating surface.

It is noted that the channels formed by the grooves and the surface of the object to be coated are not necessarily tube like, as e.g. ring elements on the levelling edge of the squeegee in contact with the surface of a cylindrical object do not provide such channels, but it is essential that passages are formed which make it possible that liquid or pasty material to be coated can be pressed, or even flow, through during coating.

The present invention in the second place relates to a squeegee assembly as described in the introductory part of the description which provides a solution for other problems encountered with such squeegee assemblies according to the state of the art. The known squeegees are usually formed individually by cutting, punching, etc. from sheet material after which the levelling edge is formed by planing, scouring or grinding of the inner edge of the annular squeegee, i.e. to provide it with the desired levelling edge with a suitable radius and curvature. This individual forming of the levelling edge is relatively complicated, expensive, labour intensive and not accurately reproducible.

The present invention however, provides a solution for the above problems by a squeegee assembly in particular intended for coating substantially cylindrical objects with a liquid or pasty material, at least comprising an annular squeegee with an outer mounting edge and an inner levelling edge, characterized in that the levelling edge of the squeegee comprises a ring member.

Ring members are commercially available in any required material, shape, cross-section, flexibility, hardness, dimensions etc. Preferably the ring member is an O-ring, advantageously having a circular or cross-shaped cross section, the latter e.g. being a so-called QUAD-ring. The ring member will in practice comprise a plastic material, preferably rubber-like material, like NBR, according to ISO1629.

The pressing force of the squeegee on the surface of the object to be coated is easily controllable by a suitable selection of the respective properties of the ring member. Such a ring member can for example be adhered to the levelling edge of currently commercially available squeegees with an adhesive or the like. Further special squeegees can also be prepared by adhering the ring member to a flexible annular squeegee element, e.g. made from silicone rubber, to provide for automatic centering of the squeegee. Such a flexible squeegee element in turn can be connected to a relatively stiff outer annular squeegee element comprising the mounting edge to facilitate and improve the mounting properties of the squeegee. Said outer squeegee element can be made of plastic, metal, hard rubber or the like.

Preferably the ring member has a Shore hardness of 50–95, more preferably 70–80.

Most preferably the levelling edge of the squeegee, in this case formed by the ring member, is provided with ridges according to the invention.

In the case of a ring member it is advantageous to form the grooves by providing the ring member with a helically wound wire. This is easy to accomplish, by firstly helically winding a wire around the ring member, after which it is secured to the squeegee or squeegee element.

In another aspect of the invention the squeegee assembly according to the invention comprising two squeegees, by means of which upward and downward coating is possible with relatively high speed and coating layer thickness. Preferably feed means for the material to be coated open out between said squeegees. Thus the pressure of the material to be coated onto the object can be adjusted as desired.

In this case most preferably the two squeegees are identical squeegees.

In a third aspect the squeegee according to the invention comprises two outer squeegees with a ring member and an inner squeegee with ridges on the levelling edge, and that feed means for the material to be coated open out between the squeegees, said outer squeegees comprising means for moving said squeegees towards and from the surface of the object to be coated. This embodiment will be described in more detail in the description of the drawing.

Finally the invention provides a squeegee suitable for use in a squeegee assembly according to the invention.

DESCRIPTION OF THE PREFERRED EMBODIMENTS

Figure 1:
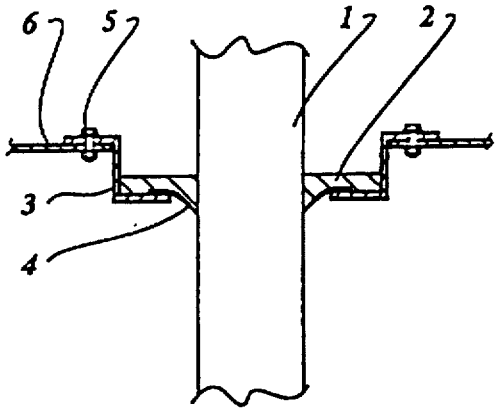
Fig. 1 ( PRIOR ART )
FIG. 1 shows a diagrammatic cross section of a squeegee assembly in a coating device according to the prior art, for upward coating.

FIG. 1 shows, diagrammatically, a coating device according to the prior art, in which a rotary screen printing cylinder 1 is coated with a lacquer 2 in the upward direction. The squeegee assembly comprises a bowl part 3, in which an annular squeegee 4 is mounted. The bowl part 3 is coupled, with the aid of a bolt/nut connection 5 to squeegee assembly mounting means in the form of a mounting component 6 of a known coating device. Said mounting component 6 is connected to generally known displacement means, which are not shown, so that the squeegee 4 can be displaced over the cylinder. Known displacement means comprise for example a chain accommodated in a guide which can be driven by means of chain wheels. Hydraulic displacement means are also known.

As is obvious from the figure, with displacement means acting non-accurately, the squeegee assembly will be subject to radial displacements with respect to the cylinder 1 to be coated, as a result of vibrations or the like which, for example, may be caused by the interaction of a chain wheel with a chain. This results in the possibility of differences in layer thickness over the dams of the screen printing cylinder and differences in penetration depth into the holes of the rotary screen printing cylinder 1 occurring. If, seen in the figure, the squeegee assembly is for example, moved towards the right somewhat with respect to the cylinder, the point of contact of squeegee 4 against the cylinder 1, on the left in the figure, will be lower than the point of contact of the squeegee 4 with the cylinder 1, on the right in the figure. Besides differences in layer thickness, this also leads to a different smoothing-off action which has an effect on the surface structure of the coating layer finally applied. Further these inaccuracies severely limit the thickness of the coating which can be applied in one coating run.

Figure 2:
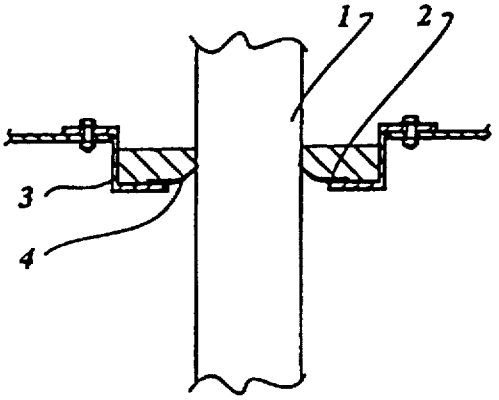
Fig. 2 ( PRIOR ART )
FIG. 2 shows a diagrammatic cross section of a squeegee assembly according to the prior art in a coating device for downward coating.

FIG. 2 illustrates the same part of a coating device as FIG. 1, but one which is intended for coating a rotary screen printing cylinder in the downward direction.

In FIG. 1 the squeegee 4 will have to be produced from a stiffer material than the squeegee 4 in FIG. 2, with the result that any eccentricity of the squeegee which may occur with respect to the cylinder to be coated in FIG. 1 thus gives rise to greater problems, in connection with the layer of lacquer to be applied, than in FIG. 2.

Figure 3:
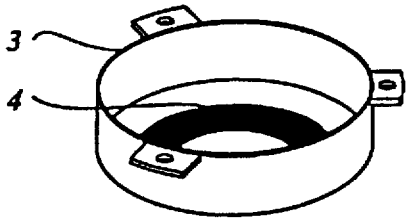
Fig. 3 ( PRIOR ART )
FIG. 3 shows a perspective view of a known squeegee assembly with a bowl part.

FIG. 3 shows diagrammatically and in perspective, the bowl part 3 with the squeegee 4 which can, for example, be used in the coating device as shown in FIG. 1 or FIG. 2.

Figure 4A:
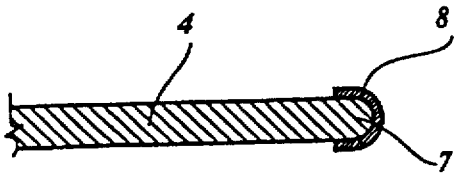
FIG. 4*a* shows a partial cross section of a squeegee according to the invention with ring elements.
Figure 4B:
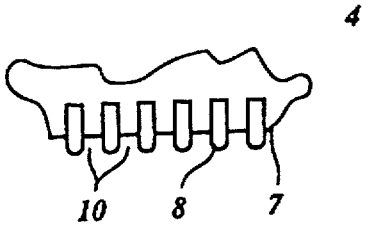
FIG. 4*b* shows a partial top view of the squeegee according to FIG. 4*a;*

FIG. 4*a* shows a cross section of a preferred embodiment of a squeegee 4 according to the invention which can be used in a squeegee assembly as shown in FIG. 3. The squeegee 4 comprises a levelling edge 7, which is locally provided with ridges in the form of spacer elements 8, which are uniformly distributed over the entire levelling edge 7. This can be seen more clearly in FIG. 4*b* being a top view of the squeegee 4 of FIG. 4*a*. Between the spacer elements 8 grooves 10 are formed. It is also possible to modify the distance between the spacer elements 8, which can vary from preferably 0 to about 10 mm.

The spacer elements 8 are formed here from C-shaped wire parts. Preferably the wire used is steel wire, although it will be clear that many other materials with similar properties can be also be used for the same purpose. The squeegee 4 will usually be made of a flexible material, like e.g. rubber.

Figure 5A:
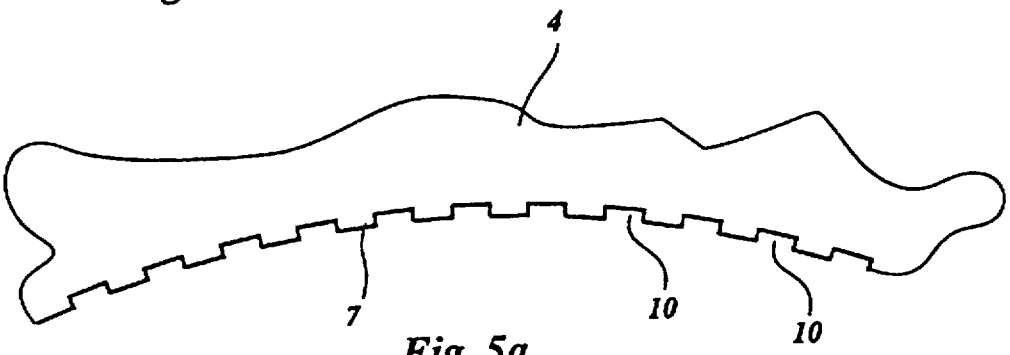
FIG. 5*a* shows a partial top view of a squeegee according to the invention.
Figure 5B:
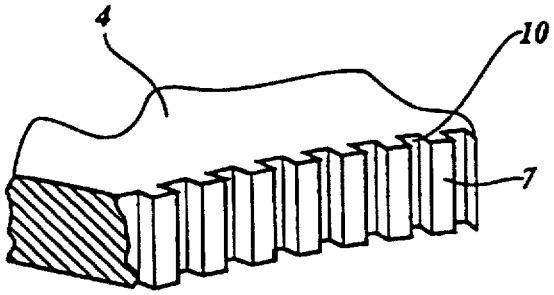
FIG. 5*b* shows a perspective view of the squeegee according to FIG. 5*a;*

FIGS. 5*a* an 5*b* respectively show a top view and a perspective view of an other embodiment of a squeegee according to the invention, wherein grooves 10 are formed by cutting away portions of the levelling edge 7 of the squeegee 4, the remaining parts of the original levelling 7 edge form the ridges.

According to the invention the shape of the ridges which during use will actually contact the surface of the cylinder to be coated, is preferably rounded off, like in FIG. 4*a*.

Figure 6A:
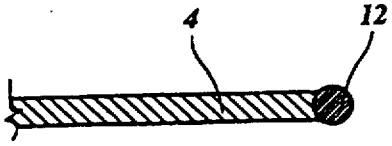
FIG. 6*a–c* show different cross sections of squeegees according to the invention with ring members.
Figure 6B:
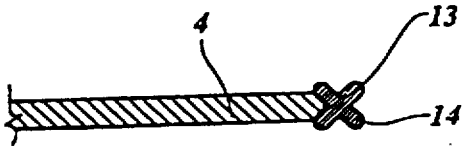
Figure 6C:
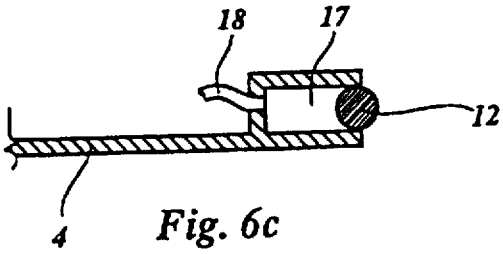

FIGS. 6*a–c* show different embodiments of squeegees 4 according to the invention comprising a ring member on the levelling edge. Hereby the properties of the part of the levelling edge which during coating actually contacts the cylinder can be very accurately selected as the properties of ring members currently commercially available are almost unlimited and can be selected as desired.

The ring member in FIG. 6*a* is an O-ring 12 with a circular cross section. The ring member in FIG. 6*b* is an O-ring having a substantially cross-shaped cross section, being a so-called QUAD-ring 13. The QUAD-ring will be secured in such a way to the squeegee 4 that the levelling edge of the resulting squeegee is formed by one of the lobes 14 thereof.

FIG. 6*c* shows a squeegee with an O-ring 12 with circular cross section, further comprising an annular pressure chamber 17, with a feed connection 18, which can be connected to a suitable source of pressurised fluid, like compressed air or the like. With this squeegee design the pressing force of the levelling edge can be controlled.

Figure 7:
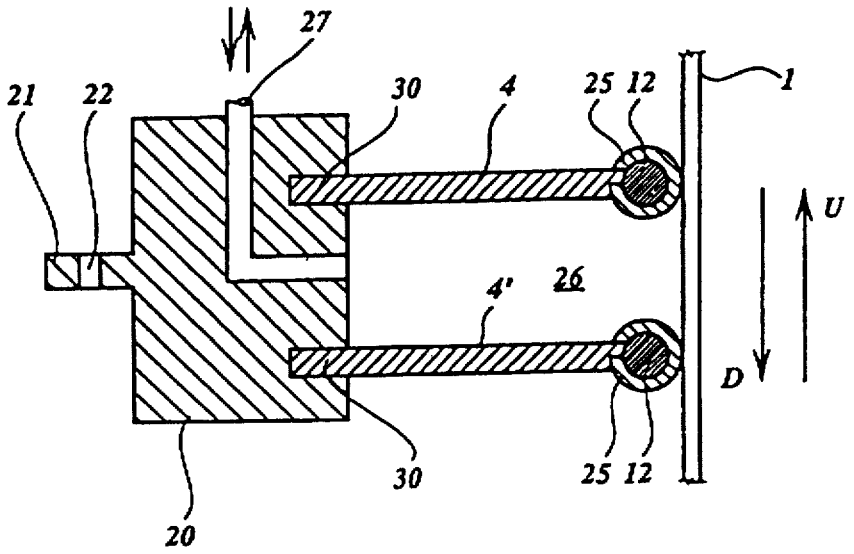
FIG. 7 shows an embodiment of a squeegee assembly according to the invention comprising two squeegees.

In FIG. 7 a preferred embodiment of a squeegee assembly according to the invention is diagrammatically illustrated. Said assembly comprises a mounting block 20 which serves for mounting the squeegees 4 and 4', as well as for mounting the assembly in a coating device. The latter can be accomplished by means of the schematically depicted mounting portion 21, comprising a hole 22.

The two squeegees 4, 4', both comprise a levelling edge formed by an O-ring 12 with circular cross section which has been provided with a helically wound steel wire 25 before being connected to the respective squeegees 4, 4'. The diameter of the steel wire is preferably 0.075–0.35 mm and more preferably 0.1–0.3 mm, whereas the distance between the turns can preferably vary between 0 and 10 mm, and more preferably between 2 and 5 mm. It is possible to embed the wire somewhat in the ring member.

Reference numeral 26 designates a coating material feed chamber which can be fed with material to be coated by means of the material feed supply channel 27.

This assembly is suitable for both upward and downward coating as shown by the arrows U and D. In both directions compared to squeegee assemblies according to the prior art a relatively high layer thickness can be applied to the cylinder in one coating run, with a high speed.

The mounting edges of the squeegees 4, 4' are designated by reference numerals 30, 30' and are secured to the mounting block 20.

Figure 8:
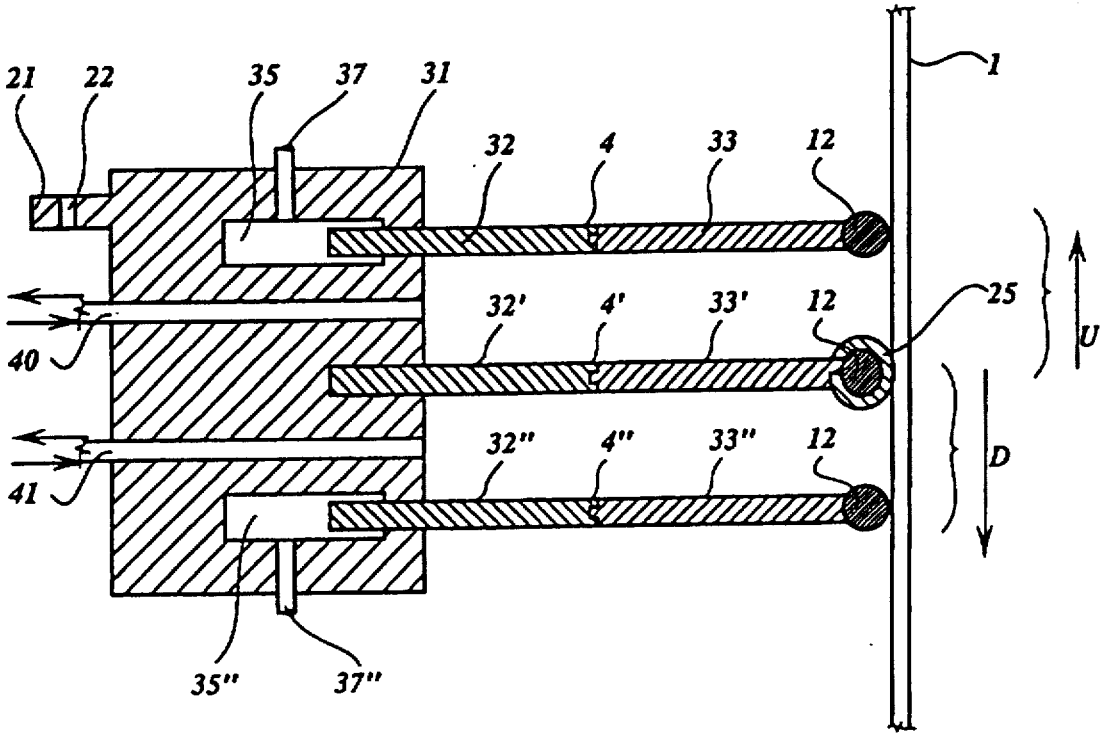
FIG. 8 shows an embodiment of a squeegee assembly according to the invention with three squeegees.

FIG. 8 shows a more complicated embodiment of a squeegee assembly according to the invention, comprising three squeegees 4, 4', 4" mounted in a mounting block 31. All squeegees 4, 4', 4" comprise two annular squeegee elements 32, 32', 32", 33, 33', 33", 32, 32', and 32" being made of a more rigid material than 33, 33', 33". For example the portion 32 can be made from RUBBER, whereas the portion 33 is preferably made from a flexible silicon compound to provide for automatic centering action.

The squeegee 4' in the middle is a squeegee with a ring member 12 and a helically wound wire 25 similar to the squeegees shown in FIG. 7. Whereas the outer squeegees 4, 4" are squeegees according to the invention without grooves, comprising an O-ring 12 with circular cross section. These squeegees 4, 4" can form a closed coating material feed chamber with the middle squeegee 4' during coating of the cylinder 1 during upward and downward coating respectively. This is indicated by the arrows U and D and the respective braces. The actual coating operation is in both directions performed by the middle squeegee 4'.

The outer squeegees 4, 4" are housed in special chambers 35, 35" in the mounting block 31, which can be connected to a pressure source for providing a positive or negative pressure in said chambers 35, 35" by means of connections 37, 37" to be able to move the respective squeegees towards and from the surface of the object to be coated. It is also feasible to provide other means for the same function. For example the portion 32 can be secured to the mounting block 31, and rings e.g. from metal can be adhered to portions 33 and 33' on the faces on the outside of the assembly. If such rings are provided with connecting members the squeegees 4 and 4" can be moved towards and from the object 1 with suitable drive means. During upward coating with the assembly the squeegee 4" will be removed from the surface of the cylinder 2 by connecting the chamber 35" to a suitable vacuum source. At the same time chamber 35 is connected to a source of a pressurised fluid to move it against the surface of the cylinder 1. For downward coating chamber 35 is connected to a vacuum source whereas chamber 35" is connected to a source of pressurised fluid.

The material to be coated is fed between the squeegees 4' and 4 for upward coating and between squeegee 4' and 4" for downward coating by feed supply channels 40, 41.

Figure 9:
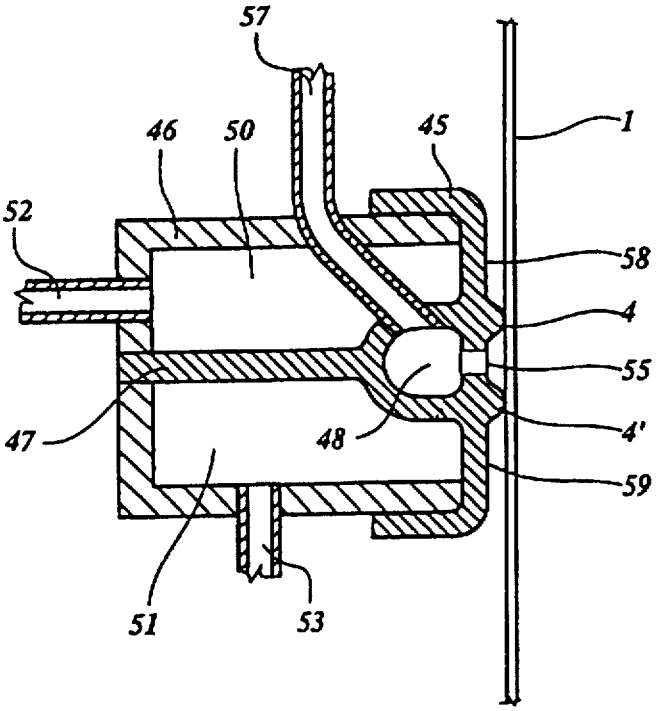
FIG. 9 shows an embodiment of a squeegee assembly according to the invention with two integrated squeegees with separate pressure chambers.
Figure 10:
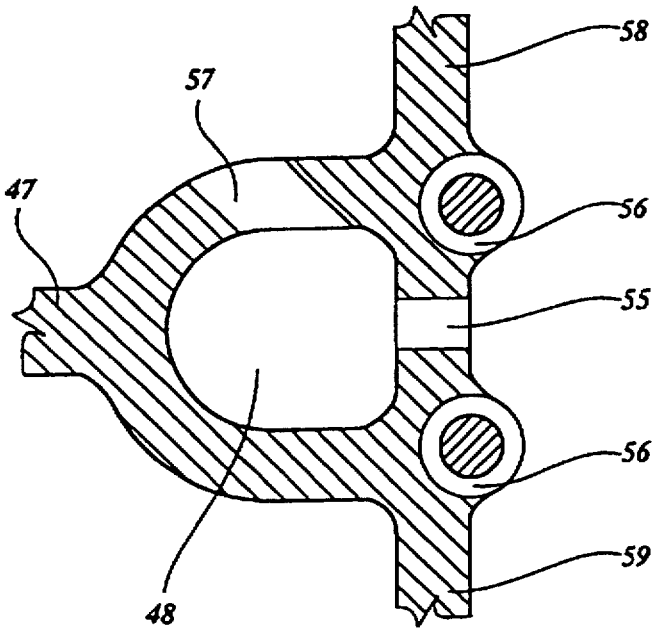
FIG. 10 shows an enlargement of the squeegees of FIG. 9.

Finally FIGS. 9 and 10 show a preferred embodiment of a squeegee assembly according to the invention comprising two squeegees 4, 4' forming part of one annular squeegee profile 45. Said profile 45 is secured to a housing 46 and comprises further a separation wall 47 and a coating material feed chamber 48.

The housing 46 is divided into two pressure chambers 50, 51 by the wall 47, both provided with pressure fluid supply connections 52, 53 for regulating the pressure in the pressure chambers 50, 51 and thereby the pressure force of the respective squeegees 4, 4' on the cylinder 1 to be coated.

The material supply chamber 48 comprises material feed openings 55 uniformly distributed over the entire profile 45 between the squeegees 4, 4'. Further said chamber 48 comprises a material supply connection 57 for feeding liquid or pasty material to be coated. The squeegees are self-centering by the presence of the wall segments 58, 59 which are part of the squeegee profile 45.

FIG. 10 shows an enlargement of the part of the profile 45 comprising the material supply chamber 48 and the squeegees 4, 4'. Said squeegees 4, 4' are formed by embedded metal rings 56 serving as spacer elements for forming the grooves according to the invention in the levelling edge of the squeegees 4, 4'. With this squeegee assembly as well as the previous assemblies it is possible to coat in two directions, while the condition of the object to be coated can vary from vertical to horizontal.

What is claimed is:

1. An assembly for coating substantially cylindrical objects with a coating material, said assembly comprising:

(a) an annular squeegee comprising a top surface, a bottom surface, an outer mounting edge and an inner leveling edge having a ridged circumferential face;

(b) feed means adjacent said annular squeegee for feeding coating material onto an object being coated by said assembly; and (c) a plurality of ridges spaced along said ridged circumferential face and extending from said top surface to said bottom surface, the spaces between said ridges defining a plurality of grooves, which grooves form channels between said ridged circumferential face and the object being coated by said assembly, and which grooves are designed to receive the coating material for coating the object.

2. An assembly according to claim 1, wherein said plurality of ridges comprise wear-resistant spacer elements for controlling file depth of said channels, said spacer elements comprising wire elements at least partially embedded in said annular squeegee.

3. An assembly according to claim 2, wherein said wire elements are ring-shaped, and are concentrically aligned along the inner leveling edge of said annular squeegee.

4. An assembly according to claim 3, wherein said ring-shaped wire elements comprise turns of a wire embedded in said annular squeegee by threading said wire through the squeegee between said top surface and said bottom surface and along the inner leveling edge in a helical fashion.

5. An assembly according to claim 4 wherein said wire is a steel wire having a coating comprising a material selected from the group consisting of metal nitride, carbide, silicide or chromide.

6. An assembly according to claim 1, wherein said plurality of grooves have a maximum depth of between 0.075 and 0.35 mm and a maximum transverse dimension of less than 10 mm.

7. An assembly according to claim 1, wherein said grooves have a maximum transverse dimension and wherein a surface of each ridge which contacts the surface of the object being coated is smaller than the maximum transverse dimension of the grooves.

8. An assembly according to claim 1, further comprising a mounting block, means for connecting said annular squeegee to said mounting block, and means from moving said annular squeegee towards and away from a surface of the object being coated.

9. An assembly according to claim 1, wherein said annular squeegee comprises an inner annular squeegee element and an outer annular squeegee element, said outer annular squeegee element being stiffer than said inner annular squeegee element.

10. An assembly for coating substantially cylindrical objects with a coating material, said assembly comprising:

(a) an annular squeegee comprising a top surface, a bottom surface, an outer mounting edge and a circumferential inner edge;

(b) feed means adjacent said annular squeegee for feeding coating material onto an object being coated by said assembly;

(c) an O-ring attached to said circumferential inner edge of said annular squeegee; and (d) a plurality of ridges projecting from said O-ring to form an inner leveling edge, said ridges having spaces therebetween defining a plurality of grooves, which grooves form channels between said O-ring and the object being coated by said assembly.

11. An assembly according to claim 10, wherein said O-ring is of substantially circular cross section.

12. An assembly according to claim 10, wherein said O-ring is of substantially cross-shaped cross section.

13. An assembly according to claim 10, wherein said plurality of ridges comprise turns of a wire helically wound about said O-ring.

14. An assembly according to claim 13 wherein said wire is a steel wire having a coating comprising a material selected from the group consisting of metal nitride, carbide, silicide or chromide.

15. An assembly according to claim 10, further comprising a mounting block, means for connecting said annular squeegee to said mounting block, and means for moving said annular squeegee towards and away from a surface of the object being coated.

16. An assembly according to claim 10, wherein said annular squeegee comprises an inner annular squeegee element and an outer annular squeegee element, said outer annular squeegee element being stiffer than said inner annular squeegee element.

17. An assembly for coating substantially cylindrical objects with a coating material, said assembly comprising:

(a) an outer annular squeegee element comprising an outer mounting edge and an inner connecting edge;

(b) an inner annular squeegee element comprising an outer connecting edge and an inner leveling edge, said outer connecting edge of said inner annular squeegee element being attached to said inner connecting edge of said outer annular squeegee element;

(c) feed means adjacent said inner annular squeegee element for feeding coating material onto an object being coated by said assembly;

(d) a plurality of ridges spaced along said inner leveling edge to form a ridged inner circumferential face;

(e) a mounting block;

(f) means for connecting said outer mounting edge of said outer annular squeegee element to said mounting block; and (g) means for moving said outer annular squeegee element relative to said mounting block, towards and away from a surface of an object being coated;

wherein said outer annular squeegee element is stiffer than said inner annular squeegee element.

* * * * *